US007515853B2

(12) United States Patent
Kimura et al.

(10) Patent No.: US 7,515,853 B2
(45) Date of Patent: Apr. 7, 2009

(54) TONER SUPPLY DEVICE AND DEVELOPING UNIT USING THE SAME

(75) Inventors: Takahiko Kimura, Ikoma (JP); Masanobu Deguchi, Kashiba (JP); Kazuya Koyama, Ikoma (JP); Ryosuke Mano, Kashiba (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 11/634,201

(22) Filed: Dec. 6, 2006

(65) Prior Publication Data

US 2007/0147899 A1 Jun. 28, 2007

(30) Foreign Application Priority Data

Dec. 27, 2005 (JP) ..... 2005-374000

(51) Int. Cl.
*G03G 15/08* (2006.01)

(52) U.S. Cl. ..... 399/258; 399/254

(58) Field of Classification Search ..... 399/252, 399/254, 256, 263, 255, 258, 262
See application file for complete search history.

(56) References Cited

U.S. PATENT DOCUMENTS

| | | | | |
|---|---|---|---|---|
| 5,455,662 | A | 10/1995 | Ichikawa et al. | |
| 5,835,827 | A | 11/1998 | Kishimoto | |
| 6,249,664 | B1 * | 6/2001 | Sato | 399/256 |
| 6,281,961 | B1 * | 8/2001 | Sako et al. | 355/27 |
| 6,366,755 | B1 * | 4/2002 | Takashima | 399/254 |
| 6,763,214 | B2 * | 7/2004 | Sugihara | 399/254 |
| 7,039,344 | B2 * | 5/2006 | Nishiyama | 399/254 |
| 7,046,945 | B2 * | 5/2006 | Nishitani et al. | 399/254 |
| 2004/0052538 | A1 * | 3/2004 | Yugeta et al. | 399/27 |
| 2006/0133856 | A1 | 6/2006 | Deguchi et al. | |

FOREIGN PATENT DOCUMENTS

| | | |
|---|---|---|
| JP | 60-138577 | 7/1985 |
| JP | 6-348127 A | 12/1994 |
| JP | 7-20705 A | 1/1995 |
| JP | 8-339115 A | 12/1996 |
| JP | 2004-109367 | 4/2004 |
| JP | 2004-317592 A | 11/2004 |

* cited by examiner

*Primary Examiner*—David M Gray
*Assistant Examiner*—Joseph S. Wong
(74) *Attorney, Agent, or Firm*—Nixon & Vanderhye P.C.

(57) ABSTRACT

A toner supply device includes: toner supply assembly for holding toner; and a toner supply assembly mounting mechanism having a housing for reserving toner supplied from the toner supply assembly and rotary parts for agitating the toner reserved in the housing. In this toner supply device, toner supplied from the toner supply assembly is fed to a developing unit after it being agitated. The toner supply device includes a multiple number of toner supply assemblies for storing toners of one color, wherein the housing is configured so as to reserve the toners supplied from the multiple toner supply assemblies in a single space, and the rotary parts mix and agitate the toners from the multiple toner supply assemblies.

11 Claims, 13 Drawing Sheets

TONER SUPPLY DEVICE AND DEVELOPING UNIT USING THE SAME

This Nonprovisional application claims priority under 35 U.S.C. §119(a) on Patent Application No. 2005-374000 filed in Japan on 27 Dec. 2005, the entire contents of which are hereby incorporated by reference.

BACKGROUND OF THE INVENTION (1) Field of the Invention

The present invention relates to a toner supply device and a developing unit using this, in particular relating to a toner supply device and a developing unit using this for use in an image forming apparatus for performing image formation with toner.

(2) Description of the Prior Art

Conventionally, in image forming apparatuses using toner, such as copiers, facsimile machines, etc., a toner supply device such as a toner cartridge etc., is used to supply toner to the developing unit to thereby achieve continuous operation of image output.

Examples of generally known methods for supplying toner to the developing unit include: a configuration in which toner stored in a toner cartridge is directly supplied to the developing unit (Patent document 1: see Japanese Patent Application Laid-open 2003-162143); and a configuration in which toner in a toner cartridge is supplied by a screw from a predetermined position to the developing unit (Patent document 2: see Japanese Patent Application Laid-open Hei 10-142936).

However, with the conventional method of directly supplying toner from the toner cartridge to the developing unit, the fluidity of the supplied toner is prone to vary, resulting in a cause of variations in image quality.

Also, in a case where fluidity of toner is improved by taking measures so that even toner which has been degraded in fluidity due to long-term inactivity or the like can be supplied without hindrance, toner beyond a controlled amount may be supplied to the developing unit, causing the problem that the toner concentration in the developer rises, exerting influence on image quality and color tones.

On the other hand, in a system in which toner is conveyed and supplied by use of a screw, in order to convey a large amount of toner to support high-speed printing, it has been necessary to enlarge the toner cartridge body so that load will not be applied to the screw. This presents the problem in that the ratio of the amount of stored toner to the interior volume of the toner cartridge becomes small.

To deal with this, as a method of conveying toner stored in a toner cartridge, there is a technique by which toner is conveyed to a predetermined position by rotating the toner cartridge itself instead of using a screw (see Patent document 3: Japanese Patent Application Laid-open Hei 7-20705, Patent document 4: Japanese Patent Application Laid-open Hei 8-339115, and Patent document 5: Japanese Patent Application Laid-open Hei 6-348127).

In accordance with this system, since toner is conveyed by rotating the toner cartridge itself, it is not necessary to provide a screw for toner conveyance inside the toner cartridge. Accordingly, it is not necessary to consider the load on the screw when toner is conveyed, so that it is possible to increase the ratio of toner stored in the toner cartridge.

However, since in the above-mentioned prior art, toner is directly discharged from the toner cartridge, it is difficult to stably convey the toner depending on the amount of toner stored in the toner cartridge, the rotational rate of the toner cartridge and other factors, hence there occurs the problem that toner cannot be supplied to the developing unit in a stable manner.

To avoid this, a toner supply device having a toner feed device that is adapted to temporarily store the toner having been conveyed and discharged from the toner cartridge and deliver it to the developing unit (see Patent document 6: Japanese Patent Application Laid-open No. 2004-317592) has been disclosed. This manipulation, even when it has such a configuration that toner is conveyance and discharged by rotating the toner cartridge body, makes it possible to stably supply the toner discharged from the toner cartridge to the developing unit by use of the toner feed device.

Yet, since the aforementioned conventional system is constructed of a number of components including a toner cartridge, a toner feed device, a toner input portion for forwarding toner to the developing unit, etc., there are the structural complexity problem and the problem that toner clogs in the toner conveyance path.

SUMMARY OF THE INVENTION

The present invention has been devised in view of the above conventional problems, it is therefore an object of the present invention to provide a toner supply device which can be simply configured and can prevent toner from clogging in the toner conveyance path, as well as to provide a developing unit using the aforementioned toner supply device.

The toner supply device and developing unit according to the present invention for solving the above problem are configured as follows.

According to the first aspect of the present invention, a toner supply device for agitating toner and delivering the agitated toner to a developing unit, includes: a plurality of toner containers for storing toners of one color; and a toner feed device having a toner reservoir for reserving toners supplied from the plurality of toner containers and a toner agitator for agitating toner in the toner reservoir, and is characterized in that the toner reservoir reserves the toners supplied from the plurality of toner containers in a single space, and the toner agitator mixes and agitates the toners from the plurality of toner containers.

A toner supply device according to the second aspect of the present invention is characterized in that, in addition to the configuration described in the above first aspect, the toner agitator includes a plurality of rotary parts each having a toner agitation rotor.

In the present invention, the toner agitation rotor refers to a structure that agitates toner as it rotates, and examples also include slit-formed ones and grating-formed ones.

A toner supply device according to the third aspect of the present invention is characterized in that, in addition to the configuration described in the above second aspect, the rotary parts are arranged near the areas around which toners from the multiple toner containers are loaded.

A toner supply device according to the fourth aspect of the present invention is characterized in that, in addition to the configuration described in the above third aspect, the toner agitator further includes a rotary part having a toner agitation rotor disposed under the rotary parts that are arranged near the areas around which toners from the multiple toner containers are loaded.

A toner supply device according to the fifth aspect of the present invention is characterized in that, in addition to the configuration described in the above second or third aspect, the rotary parts that are located side by side rotate in opposite directions.

A toner supply device according to the sixth aspect of the present invention is characterized in that, in addition to the configuration described in the above second or third aspect, the rotary parts that are located side by side are arranged such positions that their rotational loci overlap each other.

A toner supply device according to the seventh aspect of the present invention is characterized in that, in addition to the configuration described in the above second or third aspect, the rotary parts that are located side by side are made to rotate out of phase with each other.

A developing unit according to the eighth aspect of the present invention is characterized in that, in addition to the configuration described in any one of the above first through seventh aspects, gears are used to transmit driving force for rotation to the rotary parts.

According to the ninth aspect of the present invention, a developing unit equipped with a toner supply device for agitating toner and delivering the agitated toner to the developing unit, wherein the toner supply device comprising: a plurality of toner containers for storing toners of one color; and a toner feed device having a toner reservoir for reserving toners supplied from the plurality of toner containers and a toner agitator for agitating toner in the toner reservoir, is characterized in that the toner supply device uses one that has any one of the above first to eighth aspects.

According to the first aspect of the present invention, a toner supply device for agitating toner and delivering the agitated toner to a developing unit, includes: a plurality of toner containers for storing toners of one color; and a toner feed device having a toner reservoir for reserving toners supplied from the toner containers and a toner agitator for agitating toner in the toner reservoir, and is constructed such that the toner reservoir reserves the toners supplied from the multiple toner containers in a single space, and the toner agitator mixes and agitates the toners from the multiple toner containers. Thus, the toners supplied from multiple toner containers are stored in the same reservoir, mixed and agitated therein, then the mixed toner is delivered to the developing unit. As a result, it is possible to simplify the toner conveyance path to the developing unit as well as to simply the configuration of drive portion for toner agitation. In addition, since the toner is conveyed as being agitated, it is possible to realize stable toner supply by preventing occurrence of toner clogging.

Further, in addition to the above common effect that is obtained from the first to ninth aspects of the invention, each aspect of the invention has the following effect.

Detailedly, according to the second aspect of the invention, since the toner agitator includes a plurality of rotary parts each having a toner agitation rotor, this configuration, in addition to the effect achieved by the first aspect of the invention, makes it possible to agitate the toner supplied in the toner reservoir with high efficiency.

According to the third aspect of the invention, since the rotary parts are arranged near the areas around which toners from the multiple toner containers are loaded, this configuration, in addition to the effect achieved by the second aspect of the invention, makes it possible to agitate toner stored in the toner reservoir by separately stirring up the toners from different toner containers. Accordingly it is possible to achieve more efficient toner agitation.

According to the fourth aspect of the invention, since the toner agitator further includes a rotary part having a toner agitation rotor disposed under the rotary parts that are arranged near the areas around which toners from the multiple toner containers are loaded, this configuration, in addition to the effect achieved by the third aspect of the invention, makes it possible to supply the toner to the developing unit by further stirring up the agitated toner. Hence it is possible to achieve a stable toner supply.

According to the fifth aspect of the invention, since the rotary parts that are located side by side rotate in opposite directions, this configuration, in addition to the effect achieved by the second or third aspect of the invention, makes a further efficient toner agitation possible.

According to the sixth aspect of the invention, since the rotary parts that are located side by side are arranged such positions that their rotational loci overlap each other, this configuration, in addition to the effect achieved by the second or third aspect of the invention, makes a further efficient toner agitation possible with a space-saving configuration.

According to the seventh aspect of the invention, since the rotary parts that are located side by side are made to rotate out of phase with each other, this configuration, in addition to the effect achieved by the second or third aspect of the invention, makes a further efficient toner agitation possible.

According to the eighth aspect of the invention, since gears are used to transmit driving force for rotation to the rotary parts, this configuration, in addition to the effect achieved by the first through seventh aspects of the invention, simplifies the drive portions and makes it possible to realize a space-saving toner supply device.

According to the ninth aspect of the invention, a developing unit equipped with a toner supply device for agitating toner and delivering the agitated toner to the developing unit, wherein the toner supply device comprising: a plurality of toner containers for storing toners of one color; and a toner feed device having a toner reservoir for reserving toners supplied from the toner containers and a toner agitator for agitating toner in the toner reservoir, is constructed such that the toner supply device uses one that has any one of the above first to eighth aspects. Thus, it is possible to simplify the toner conveyance path to the toner supply device as well as to provide a simple driving portion. It is also possible to realize stable toner supply by preventing occurrence of toner clogging with a space-saving configuration. As a result it is possible to provide a developing unit suitable for large-volume printing.

DESCRIPTION OF THE PREFERRED EMBODIMENTS

The best mode for carrying out the present invention will be described with reference to the drawings.

Figure 1:
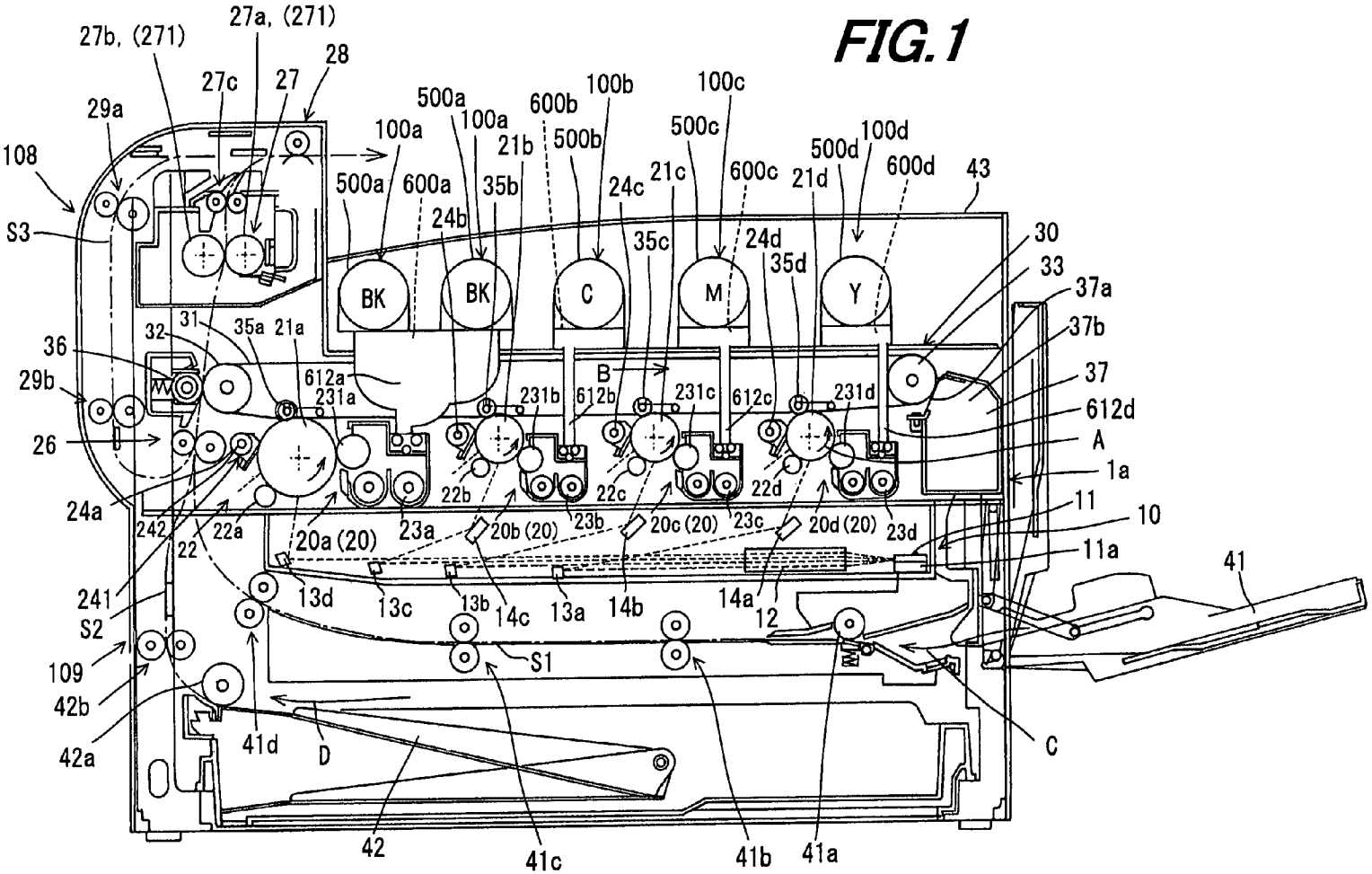
FIG. 1 is an illustrative view showing an overall configuration of an image forming apparatus adopting a toner supply device according to the present invention.

FIG. 1 is an example of the mode for carrying out the present invention, and is an illustrative view showing an overall configuration of an image forming apparatus adopting a developing unit according to the present invention.

As shown in FIG. 1, the present embodiment is a developing unit 23 (23*a*, 23*b*, 23*c* or 23*d*) for use in an image forming apparatus 1 in which developer images are formed with developers supplied from developing rollers 231 (231*a*, 231*b*, 231*c* and 231*d*) on photoreceptor drums 21 (21*a*, 21*b*, 21*c* and 21*d*) in accordance with image data and transferred to a recording sheet by a transfer process, and each developing unit includes a toner supply device 100 (100*a*, 100*b*, 100*c* or 100*d*) having a toner bottle (toner container) 200 (200*a*, 200*b*, 200*c* or 200*d*, FIG. 5) for storing toner and a toner supply assembly mounting mechanism 600 (600*a*, 600*b*, 600*c* or 600*d*, FIGS. 5 and 6) as a toner feed device for reserving toner supplied from the toner bottle 200 and feeding the toner after agitation to developing unit 23, so as to perform automatic toner supply to the developing unit 23.

As shown in FIG. 1, image forming apparatus 1 to which developing units 23 according to the present embodiment are mounted includes: a plurality of process printing units (image forming means) 20 (20*a*, 20*b*, 20*c* and 20*d*) each having a photo receptor drum 21 (21*a*, 21*b*, 21*c* or 21*d*) on which a developer image (which will be referred to as "toner image" hereinbelow) is formed with a developer (which will be referred to as "toner" hereinbelow) corresponding to the color of color-separated image information and a developing unit 23 for supplying the developer to the photoreceptor drum 21 surface; an exposure unit (light scanning device) 10 for creating electrostatic latent images on photoreceptor drums 21 of individual colors by illumination of laser beams in accordance with image information; a transfer belt unit 30 having an endless transfer belt 31 for conveying toner images; and a fixing unit 27 for thermally fixing the toner images transferred to recording paper, by means of a heat roller 27*a* and a pressing roller 27*b*.

To begin with, the overall configuration of image forming apparatus 1 will be described.

As shown in FIG. 1, image forming apparatus 1 according to the present embodiment is a so-called digital color printer which is adapted to output a color image by separating image information into colors and forming images of individual colors, is mainly composed of an image forming portion 108 and a paper feed portion 109, and forms multi-color images or monochrome images on recording paper in accordance with a print job sent from an information processor (not illustrated) such as a personal computer etc., externally connected.

Image forming portion 108 forms multi-color images based on electro photography with yellow (Y), magenta (M), cyan (C) and black (BK) colors. This image forming portion is mainly composed of exposure unit 10, process printing units 20, fixing unit 27, a transfer belt unit 30 having transfer belt 31 as a transfer means, transfer roller 36 and a transfer belt cleaning unit 37.

In the overall arrangement of image forming portion 108, fixing unit 27 is disposed on the top at one end side of a housing 1*a* of image forming apparatus 1, transfer belt unit 30 is extended under the fixing unit 27 from one end side to the other end side of housing 1*a*, process printing units 20 are disposed under the transfer belt unit 30, and exposure unit 10 is disposed under the process printing units 20.

Further, transfer belt cleaning unit 37 is arranged on the other end side of transfer belt unit 30. Also, a paper output tray 43 is arranged contiguous to fixing unit 27, over image forming portion 108. Paper feed portion 109 is arranged under the image forming portion 108.

In the present embodiment, as process printing units 20, four process printing units 20*a*, 20*b*, 20*c* and 20*d*, corresponding to individual colors, i.e., black (BK), yellow (Y), magenta (M) and cyan (C), are arranged sequentially along transfer belt 31.

These process printing units 20 (20*a*, 20*b*, 20*c* and 20*d*) are arranged in parallel to each other, in the approximately horizontal direction (in the left-to-right direction in the drawing) in housing 1*a*, and include respective photoreceptor drums 21 (21*a*, 21*b*, 21*c* and 21*d*) as the image support for each individual associated color, respective chargers (charging means) 22 (22*a*, 22*b*, 22*c* and 22*d*) for charging the photoreceptor drums 21, respective developing units (developing means) 23 (23*a*, 23*b*, 23*c* and 23*d*) and respective cleaner units 24 (24*a*, 24*b*, 24*c* and 24*d*) and other components.

Here, the symbols a, b, c, and d added to the constituents for individual colors show correspondence to black (BK), yellow (Y), magenta (M) and cyan (C), respectively. In the description hereinbelow, however, the constituents provided for each color are generally referred to as photoreceptor drum 21, charger 22, developing unit 23, and cleaner unit 24, except in the case where the constituents corresponding to a specific color need to be specified.

Photoreceptor drum 21 is arranged so that part of its outer peripheral surface comes into contact with the surface of transfer belt 31 while charger 22 as an electric field generator, developing unit 23 and cleaner unit 24 are arranged along, and close to, the outer peripheral surface of the drum.

As charger 22, a corona-wire charger is used and arranged, at a position on the approximately opposite side across photoreceptor drum 21, from transfer belt unit 30 and close to the outer peripheral surface of photoreceptor drum 21. Though in the present embodiment a corona-wire charger is used as charger 22, any type of charger can be used without limitation, in place of the corona-wire charger, such as a fur brush type charger, magnetic brush type charger, roller-type charger, saw-toothed type charger, ion-generation charging device etc., as long as it can provide the desired charge performance to the photoreceptor drum.

Developing units 23*a*, 23*b*, 23*c* and 23*d* hold associated toners of black (BK), yellow (Y), magenta (M) and cyan (C) colors, each developing unit 23 being arranged on the downstream side of charger 22 with respect to the rotational direction of the photoreceptor drum (in the direction of arrow A in the drawing).

In developing units 23*a*, 23*b*, 23*c* and 23*d*, in order to deal with high-speed and large-volume printing, toner supply devices 100*a*, 100*b*, 100*c* and 100*d* equipped with five toner supply assemblies 500*a*, 500*b*, 500*c* and 500*d* for supplying developers to respective developing units 23*a*, 23*b*, 23*c* and 23*d*. Developing rollers 231*a*, 231*b*, 231*c* and 231*d* are arranged opposing respective photoreceptor drums 21*a*, 21*b*, 21*c* and 21*d*, so as to supply the associated colors of toners to the electrostatic latent images formed on the outer peripheral surfaces of photoreceptor drums 21*a*, 21*b*, 21*c* and 21*d*, respectively to visualize them.

As the developers to be supplied, developers of black (BK), yellow (Y), magenta (M) and cyan (C) colors are stored in toner supply assemblies 500*a*, 500*b*, 500*c* and 500*d*, respectively.

Here, two toner supply assemblies 500*a* for black (BK) developer are arranged side by side in order to support large-volume printing, taking into account the practice that monochrome printing is usually used most frequently.

Each toner supply assembly 500 is arranged at a position approximately directly above the developing unit 23 of the corresponding developer, and is connected to the corresponding developing unit 23 by means of a developer supply passage part 612 (612*a*, 612*b*, 612*c* or 612*d*).

Here, supply passage part 612*a* for supplying the black (BK) developer is constructed so that the developer from two toner supply devices 100*a* and 100*a* can be put together and supplied to developing unit 23*a*.

Cleaner unit 24 is arranged on the upstream side of charger 22 with respect to the rotational direction of the photoreceptor drum. Cleaner unit 24 has a cleaning blade 241 and is configured so that the cleaning blade 241 is positioned in abutment with the outer peripheral surface of photoreceptor 21 so as to scrape and collect the leftover toner off the photo receptor drum 21. A reference numeral 242 in the drawing designates a conveying screw for conveying the collected toner.

In the present embodiment, cleaning blade 241 is used but the cleaning unit is not limited to this configuration. One or more cleaning blades may be used or a fur-brush or magnetic brush may be used alone. Alternatively, a fur-brush or magnetic brush may be used in combination with a cleaning blade. That is, any configuration may be used as long as it can scrape and collect the leftover toner off the photoreceptor drum 21.

Exposure unit 10 is mainly composed of a box-shaped housing, a laser scanning unit (LSU) 11 having a laser illuminator 11*a* incorporated therein, a polygon mirror 12 and reflection mirrors 13*a*, 13*b*, 13*c*, 13*d*, 14*a*, 14*b* and 14*c* etc. for reflecting the laser beams for associated colors.

The laser beam emitted from the laser illuminator of laser scanning unit 11 is separated into conveyance path; color components by polygon mirror 12 and an unillustrated f-θ lens, then the separated components of light are reflected by reflection mirrors 13*a* to 13*d* and 14*a* to 14*c* to illuminate the respective photoreceptor drums 21*a*, 21*b*, 21*c* and 21*d* of individual colors.

Here, concerning laser scanning unit 11, a writing head made up of an array of light emitting devices such as EL (electro luminescence), LED (light emitting diode) and others, may be used instead of the laser illuminator. Also, a light source in combination with a liquid crystal shutter may be used. That is, any configuration can be used as long as it can create an electrostatic latent image on the photoreceptor drum 21 surface.

As shown in FIG. 1, transfer belt unit 30 is essentially composed of transfer belt 31, a transfer belt drive roller 32, a transfer belt driven roller 33 and intermediate transfer rollers 35*a*, 35*b*, 35*c* and 35*d*.

In the following description, any of intermediate transfer rollers 35*a*, 35*b*, 35*c* and 35*d* will be referred to as intermediate transfer roller 35 when general mention is made.

Transfer belt 31 is formed of an endless film of about 75 μm to 120 μm thick. Transfer belt 31 is essentially made from polyimide, polycarbonate, thermoplastic elastomer alloy or the like.

Also, transfer belt 31 is tensioned by transfer belt drive roller 32, transfer belt driven roller 33 and intermediate transfer rollers 35 so that its surface comes into contact with the outer peripheral surfaces of photoreceptor drums 21, and is adapted to move in the auxiliary scan direction (in the direction of arrow B in the drawing) by the driving force of the transfer belt drive roller 32.

Transfer belt drive roller 32 is disposed at one end side of housing 1*a* and drives the transfer belt 31 by applying a driving force to transfer belt 31 whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the fixing unit 27 side to the other end side of housing 1*a*, in cooperation with transfer belt drive roller 32. However, if the dimension in the width direction of image forming apparatus 1 in FIG. 1 needs to be smaller, that is, if the foot print is made smaller with respect to the width direction in order to achieve space-saving, the position of transfer belt drive roller 32 maybe displaced so that transfer belt 31 is inclined in either way from the fixing unit 27 side to the other of housing 1*a* while the photo receptors, developing units, laser illuminator, fixing unit and other components may be rearranged and resized as appropriate in association with that change in layout.

Intermediate transfer rollers 35 are arranged in the interior space of transfer belt 31 wound between transfer belt drive roller 32 and transfer belt driven roller 33. Further, they may be positioned with their axes displaced relative to corresponding photoreceptor drums 21, in the lateral direction in the drawing, to the downstream side with respect to the moving direction of transfer belt 31, so as to press the inner surface of transfer belt 31 and bring its outer peripheral surface into contact with part of the outer peripheral surface of each photoreceptor drum 21, forming a predetermined amount of nip.

Furthermore, intermediate transfer roller 35 is formed of a metal (e.g., stainless steel) shaft having a diameter of 8 to 10 mm and a conductive elastic material such as EPDM, foamed urethane etc., coated on the outer peripheral surface of the metal shaft. However, the configuration should not be limited to use of these elastic materials.

The thus formed intermediate transfer roller 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

The visualized toner images (electrostatic images) formed on the photoreceptor drums 21 correspondingly to respective colors are transferred one over another on transfer belt 31, reproducing the image information that has been input to the apparatus. The thus formed laminated image information is transferred to the recording sheet by transfer roller 36 disposed at its contact point with transfer belt 31.

Transfer roller 36 as a constituent of the transfer means is a component for transferring the developer image transferred to transfer belt 31 to recording paper, and is arranged opposing transfer belt drive roller 32 at approximately the same level and in parallel thereto and pressing against the transfer belt 31 wound on the transfer belt driver roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to deliver the recording sheet toward the transfer roller 36 side by aligning the front end of the sheet fed from paper feed portion 109 with the leading end of the toner image on transfer belt 31.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, transfer belt cleaning unit 37 is adapted to remove and collect such toner.

Transfer belt cleaning unit 37 includes: a cleaning blade 37*a*, located near transfer belt driven roller 33 and arranged so as to abut (come into sliding contact with) transfer belt 31; and a box-like toner collector 37*b* for temporarily holding the waste toner, left over on and scraped from transfer belt 31 by the cleaning blade 37*a*, to thereby scrape and collect the leftover toner off the transfer belt 31 surface.

Also, transfer belt cleaning unit 37 is arranged near process printing unit 20*a*, on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Fixing unit 27 includes: as shown in FIG. 1, a pair of fixing rollers 271 consisting of a heat roller 27*a* and pressing roller 27*b*; and a conveying roller 27*c* above the fixing rollers 271. A recording sheet is input from below fixing rollers 271 and output to above conveying roller 27*c*.

Above fixing unit 27 a paper discharge roller 28 is arranged so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep heat roller 27*a* at a predetermined temperature (fixing temperature) while the recording sheet with a toner image transferred thereon is heated and pressed between heat roller 27*a* and pressing roller 27*b* as it is being conveyed and rolled thereby, so that the toner image is thermally fused onto the recording sheet.

A duplex printing paper path S3 for double-sided printing is constructed adjacent to fixing unit 27, from the rear side of fixing unit 27 downward to the vicinity of paper feed portion 109. Conveying rollers 29*a* and 29*b* are arranged at the top and bottom and along the duplex printing paper path S3, thereby the recording sheet is inverted and delivered again toward transfer roller 36.

Specifically, conveying roller 29*a* is disposed at the rear of fixing unit 27 and conveying roller 29*b* is located below conveying roller 29*a* with respect to the top and bottom direction and at approximately the same level as registration roller 26.

In the present embodiment, heat roller 27*a* using a heating means made up of a heater lamp etc., is used with pressing roller 27*b*, but an induction heating type heating means may be used alone or in combination. Further, it is not necessary to use a roller as a means for applying pressure. That is, any appropriate method can be used as long as it can uniformly fix the toner image with heat without causing any image disturbance.

Paper feed portion 109 includes a manual feed tray 41 and paper feed cassette 42 for holding recording paper to be used for image forming, and is adapted to deliver recording paper, sheet by sheet, from manual feed tray 41 or paper feed cassette 42 to image forming portion 108.

As shown in FIG. 1, manual feed tray 41 is arranged at one side end (on the right side in the drawing) of housing la of image forming apparatus 1 so that it can be unfolded outside when used and folded up to the one end side when unused. This tray delivers paper, sheet by sheet, into the housing 1*a* of image forming apparatus 1 when the user places a few recording sheets (necessary number of sheets) of a desired type.

Arranged inside housing 1*a* of image forming apparatus 1 on the downstream side with respect to the manual feed tray 41's paper feed direction of recording paper (the direction of arrow C in the drawing) is a pickup roller 41*a* at the side of exposure unit 10. A conveying roller 41*b* is also disposed at approximately the same level further downstream with respect to the paper feed direction.

Pickup roller 41*a* touches one edge part of the surface of the recording sheet that is fed from manual feed tray 41 and reliably conveys the paper, sheet by sheet, by the function of roller's frictional resistance.

The aforementioned pickup roller 41*a* and conveying rollers 41*b*, 41*c* and 41*d* constitute a recording paper conveying path S1.

On the other hand, paper feed cassette 42 is arranged under the image forming portion 108 and exposure unit 10 in housing 1*a*, so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a*. A conveying roller 42*b* is also provided on the downstream side of the pickup roller 42*a* with respect to the pickup roller 42*a*'s paper feed direction.

Pickup roller 42*a* touches one edge part of the surface of the topmost sheet of a stack of recording sheets set on the paper feed cassette 42 in response to a printout request and reliably picks up and feeds the paper, sheet by sheet, by the function of roller's frictional resistance.

Conveying roller 42*b* conveys the recording sheet delivered from pickup roller 42*a* upward along a recording sheet feed path S2 formed on one end side inside housing 1*a* to image forming portion 108.

Next, image output by image forming apparatus 1 of the present embodiment will be described.

Image forming apparatus 1 is constructed so as to transfer the toner images formed on photo receptor drums 21 to a recording sheet fed from paper feed portion 109 by a so-called intermediate transfer process (offset process) via transfer belt 31.

First, charger 22 uniformly electrifies the outer peripheral surface of photoreceptor drum 21 at a predetermined voltage. Each electrified photoreceptor drum 21 is irradiated with a laser beam from exposure unit 10, so that an electrostatic latent image for each color is formed on the photoreceptor drum 21 for the color.

Next, toner is supplied from developing units 23 (23*a*, 23*b*, 23*c* and 23*d*) to the outer peripheral surfaces of photoreceptor drums 21 (21*a*, 21*b*, 21*c* and 21*d*) so that the static latent images formed on the outer peripheral surfaces of photoreceptor drums 21 are visualized with toner so as to form toner images.

Then, the toner image formed on photoreceptor drum 21 is transferred to transfer belt 31.

Transfer of the toner image from photoreceptor drum 21 to transfer belt 31 is done by application of a high voltage from intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presenting the opposite polarity (+). Thereby, the toner image bearing negative (−) charge on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31, laid over, one over another, in the order of yellow (Y), magenta (M), cyan (C) and black (BK) as transfer belt 31 moves to come into contact with each of the rotating photoreceptor drums 21, forming a color toner image on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image having been transferred on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by the function of transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When the recording paper placed on manual feed tray 41 is used, as shown in FIG. 1 the paper is taken in by pickup roller 41*a* from manual feed tray 41, sheet by sheet, at controlled timings in accordance with the instructions from a control panel (not shown), and fed into the machine.

The recording sheet thus taken into the machine is conveyed along recording paper feed path S1 by conveying roller 41*b* to image forming portion 108.

When the recording paper accommodated in paper feed cassettes 42 is used, the paper is separated and fed from paper feed cassette 42, sheet by sheet, by pickup roller 42*a* in accordance with a printout request and conveyed by conveying roller 42*b* along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image transferred thereon is conveyed approximately vertically and reaches fixing unit 27, where the toner image is thermally fixed to the recording sheet by heat roller 27*a* and pressing roller 27*b*.

When one-sided printing is selected, the recording sheet having passed through fixing unit 27 is discharged by discharge roller 28 and placed face down on paper output tray 43.

In contrast, when double-sided printing is selected, the recording sheet is stopped and nipped at paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed. Illustratively, the leading edge of the sheet at the first printing is directed to the trailing end when the underside is printed, or the trailing edge of the sheet at the first printing is directed to the leading end when the underside is printed.

After the toner image is transferred and thermally fixed to the underside of the recording sheet, the sheet is discharged to paper output tray 43 by paper discharge roller 28.

Thus, the transfer operation to recording paper is performed.

Next, the configuration of developing unit 23 and toner supply device 100 according to the present embodiment will be described in detail with reference to the drawings.

Figure 2:
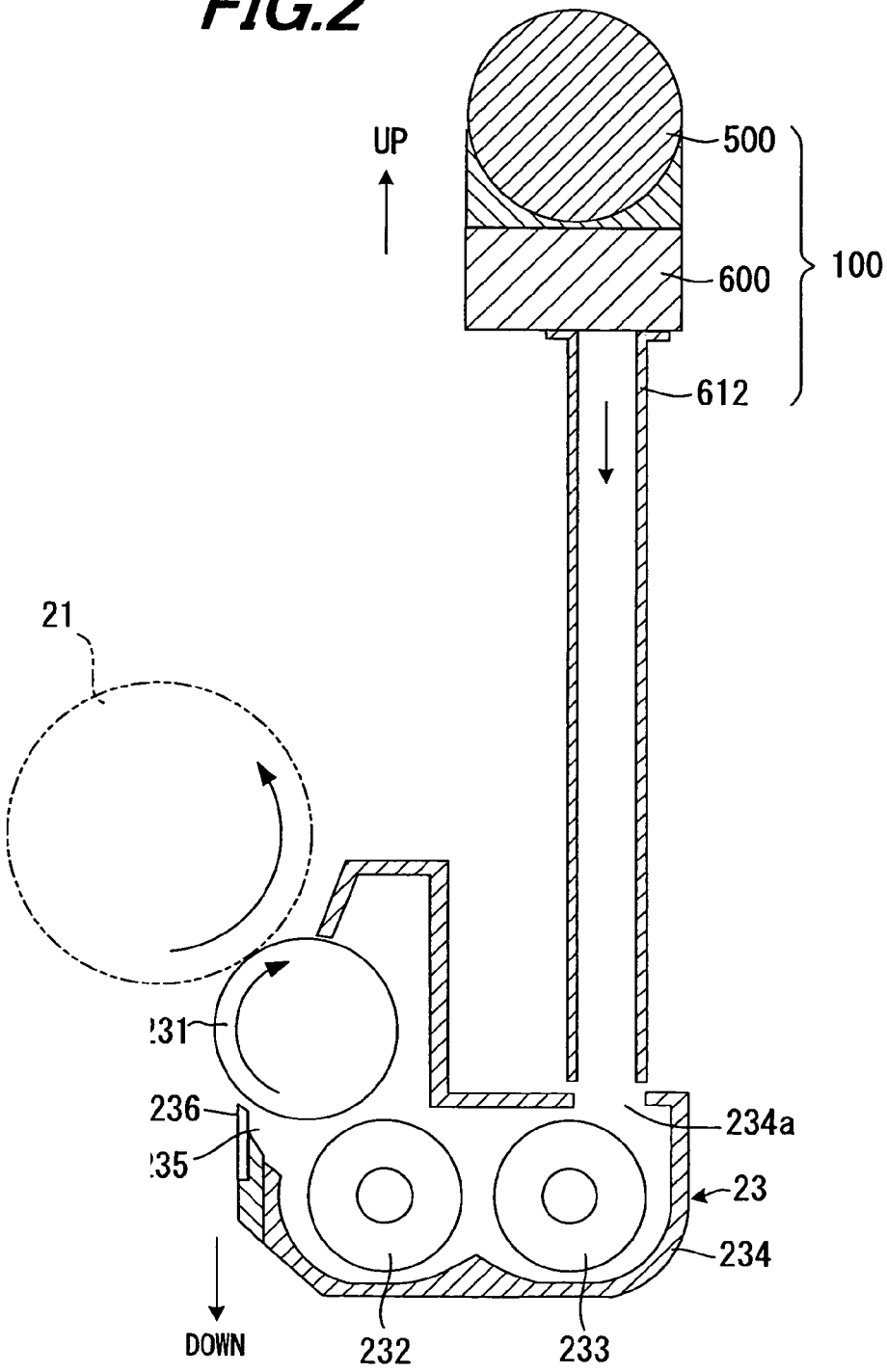
FIG. 2 is a schematic side sectional view showing a configuration of a developing unit and a toner supply device that constitute the image forming apparatus.
Figure 3:
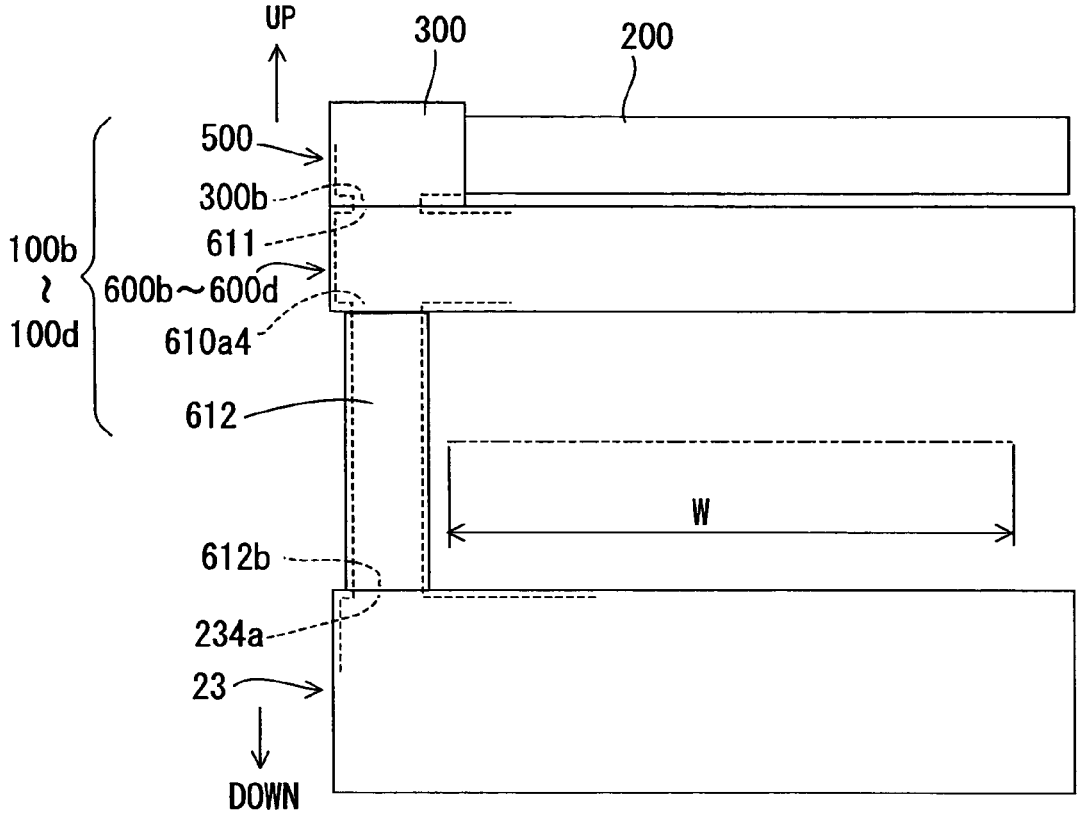
FIG. 3 is an overall front view showing the developing unit and toner supply device.
Figure 4:
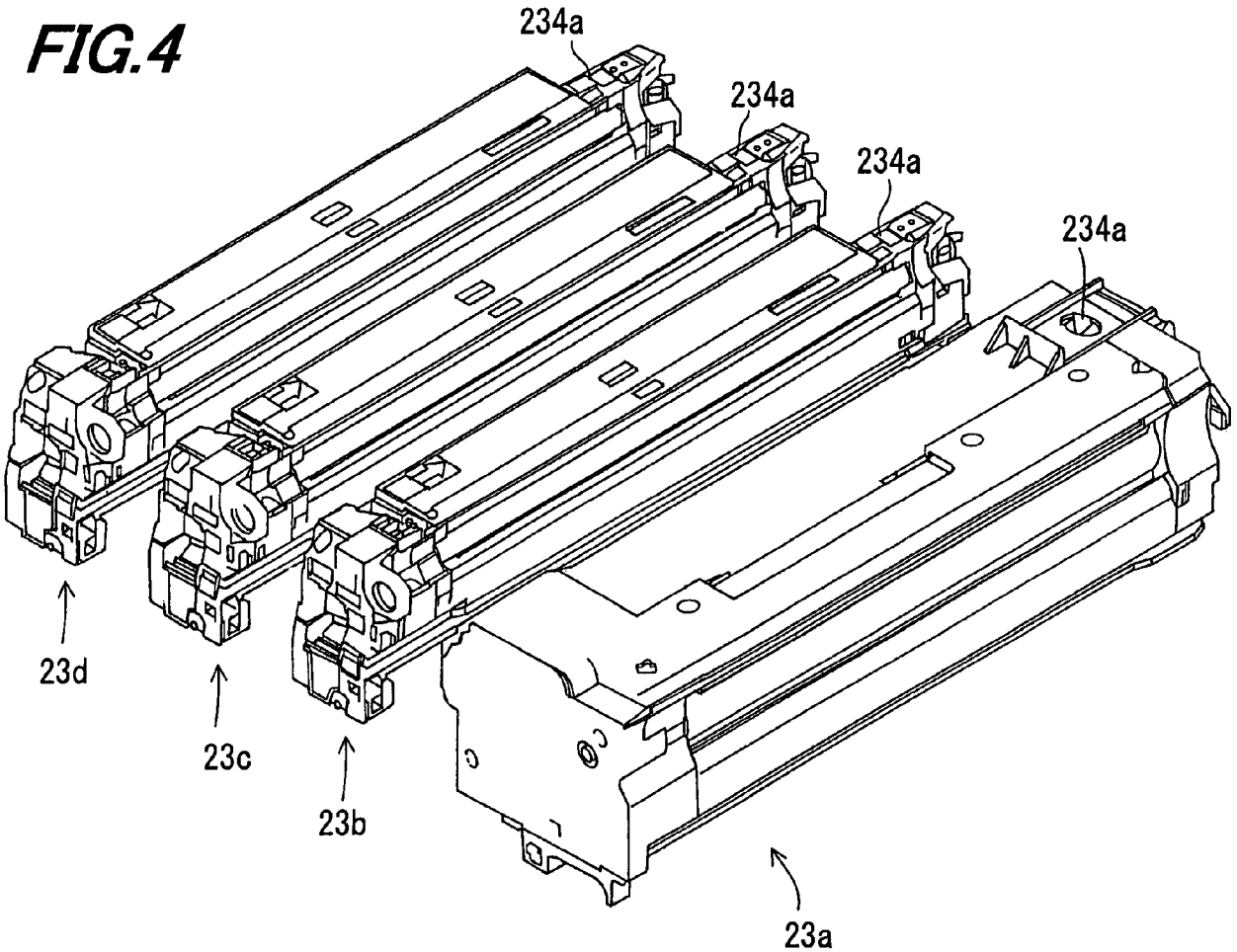
FIG. 4 is a perspective view showing the configuration of the developing unit.
Figure 5:
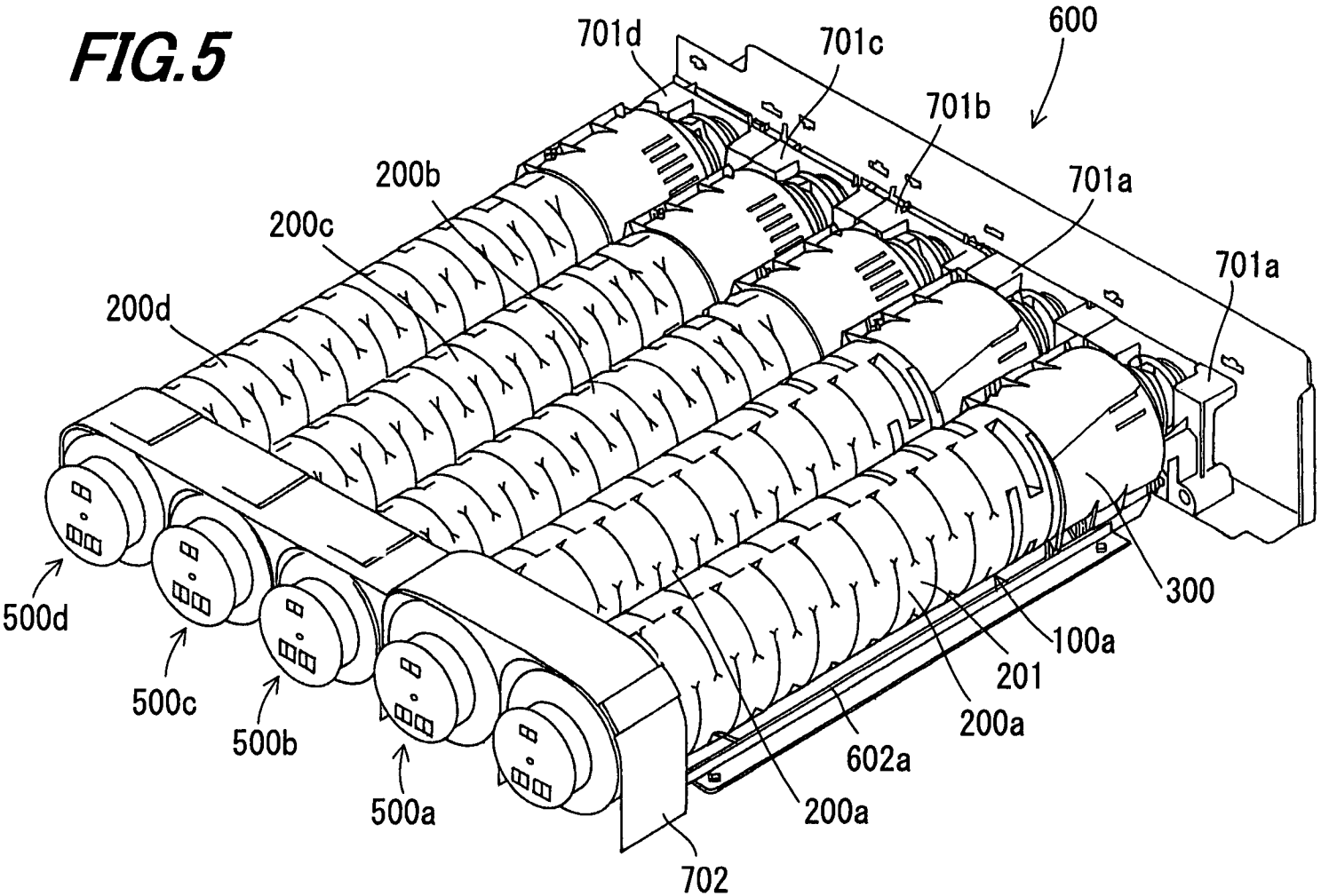
FIG. 5 is a perspective view showing a mounting example when toner supply assemblies are set in toner supply assembly mounting mechanisms that constitute the toner supply devices.
Figure 6:
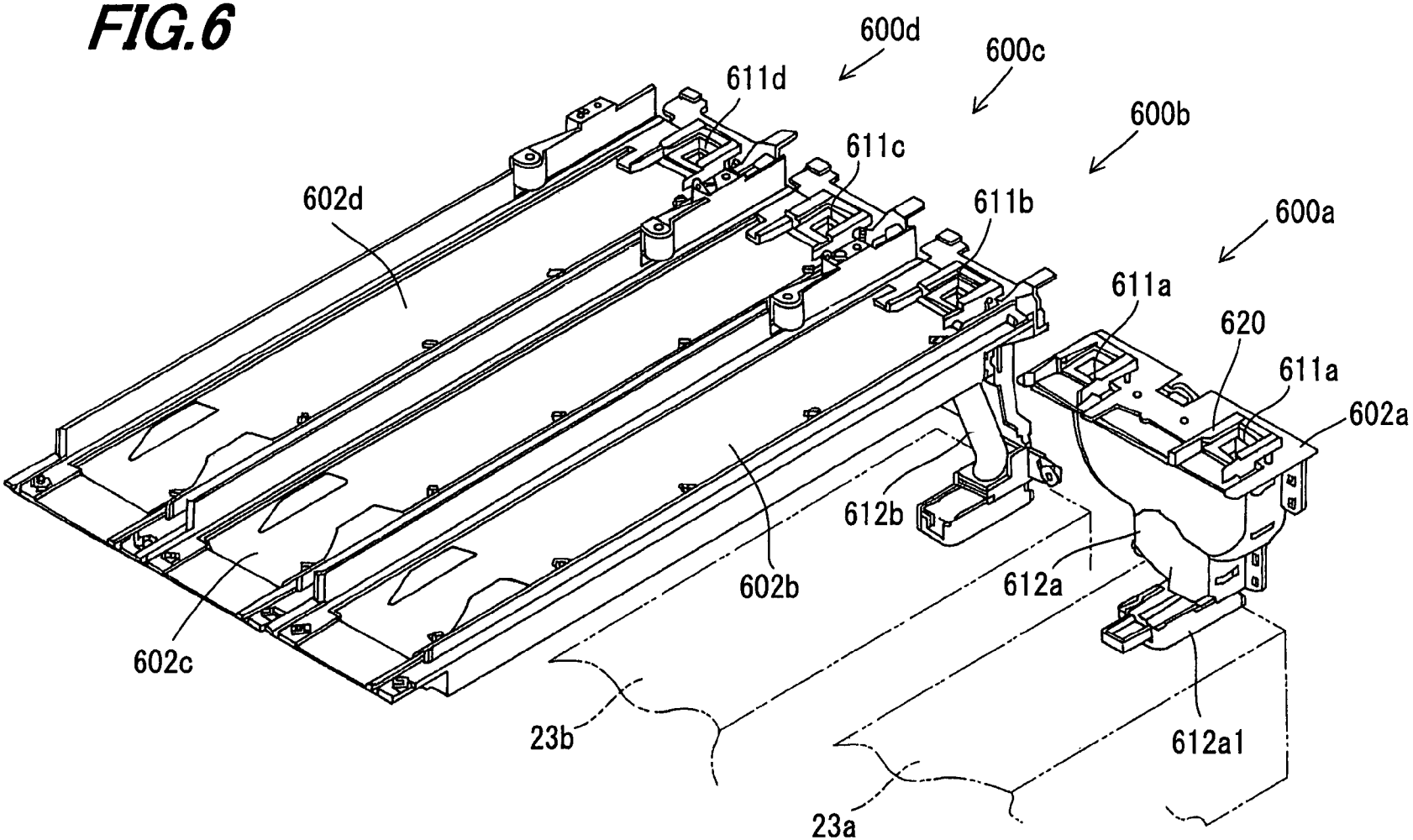
FIG. 6 is a perspective view showing a configuration of the toner supply assembly mounting mechanism.
Figure 7:
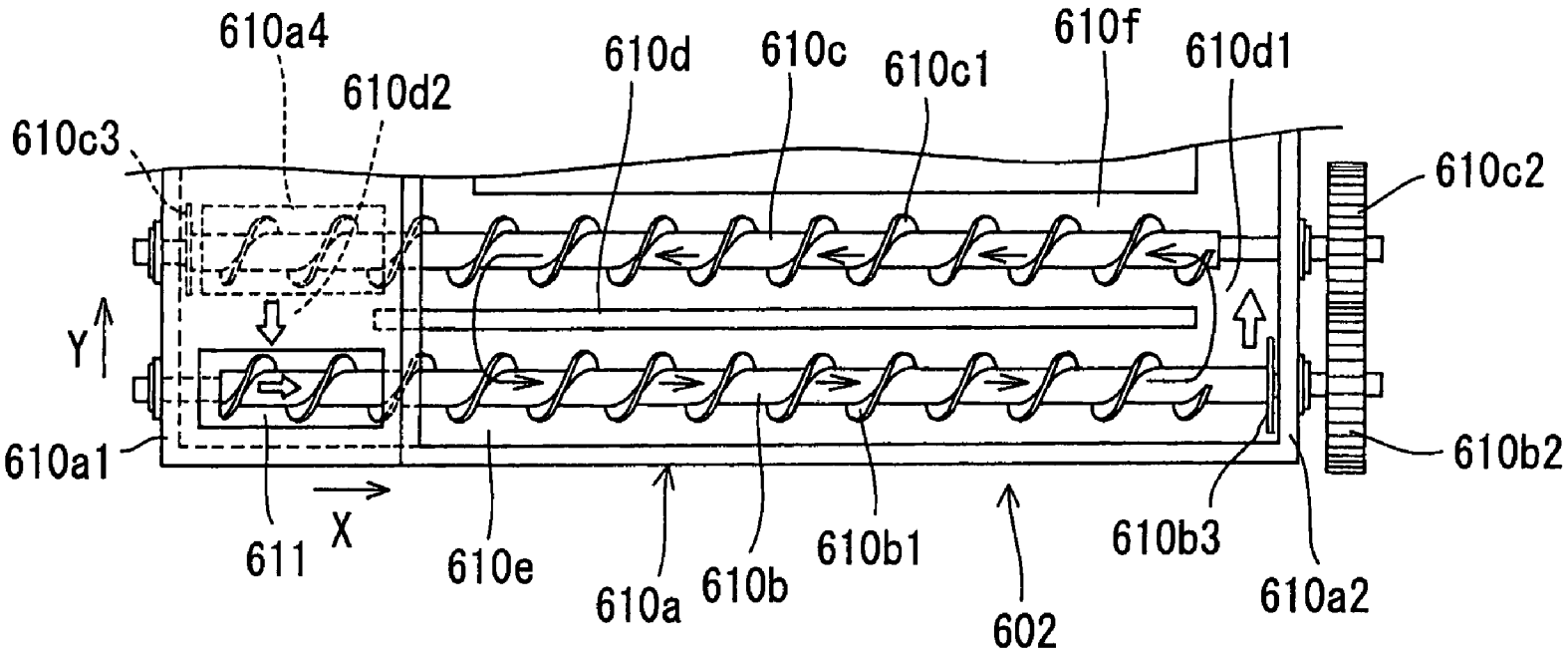
FIG. 7 is an illustrative view showing a configuration of the toner supply assembly mounting mechanism.
Figure 8:
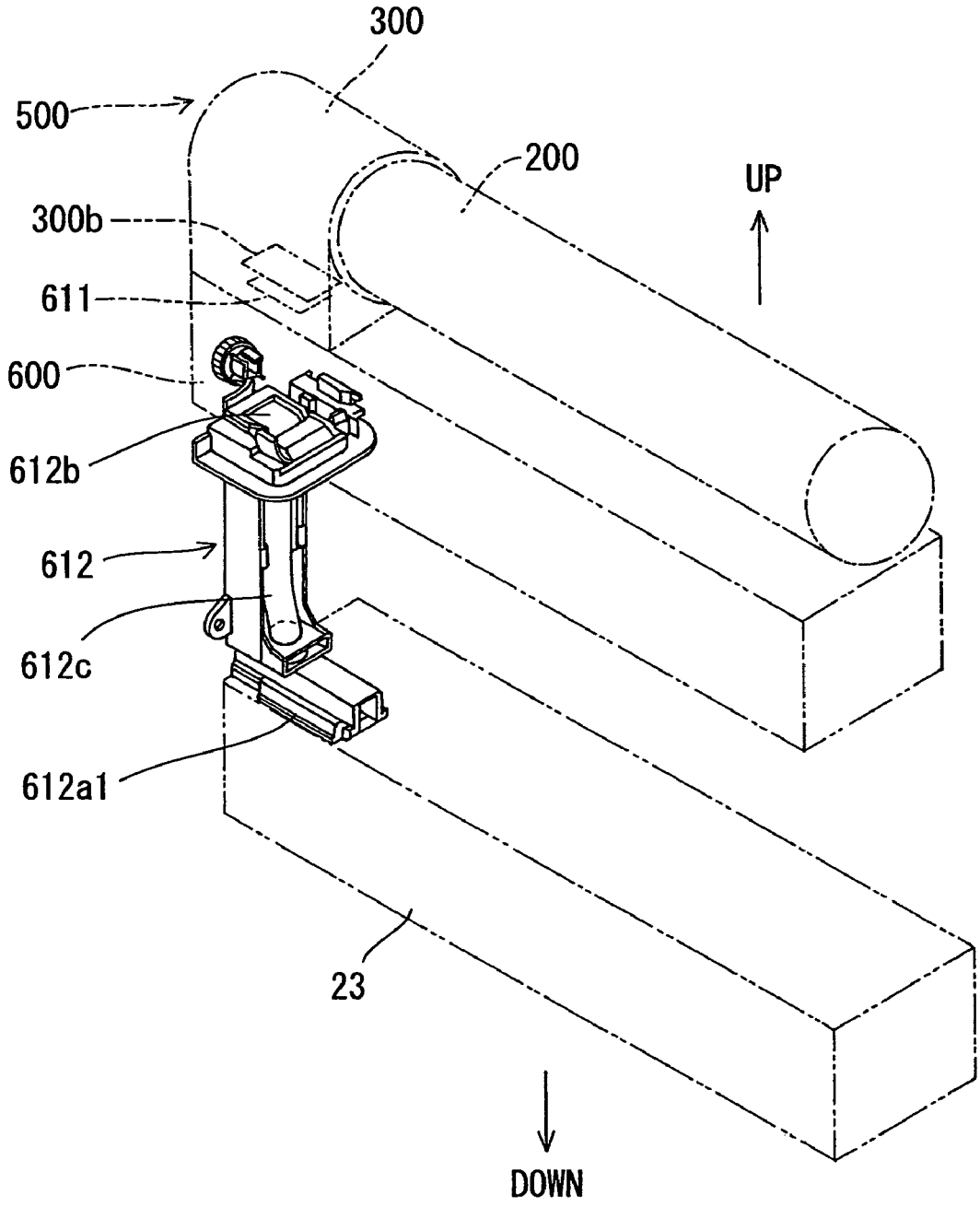
FIG. 8 is an illustrative view showing a configuration of a supply passage part for coupling the toner supply assembly mounting mechanism with a developing unit.

FIG. 2 is a schematic side sectional view showing a configuration of a developing unit and a toner supply device that constitute an image forming apparatus of the present embodiment; FIG. 3 is an overall front view showing the developing unit and toner supply device; FIG. 4 is a perspective view showing the configuration of the developing unit mounted to the image forming apparatus according to the present embodiment; FIG. 5 is a perspective view showing a mounting example when toner supply assemblies are set in a toner supply assembly mounting mechanism that constitutes the toner supply device according to the present embodiment; FIG. 6 is a perspective view showing a configuration of the toner supply assembly mounting mechanism; FIG. 7 is an illustrative view showing a configuration of the toner supply assembly mounting mechanism; and FIG. 8 is an illustrative view showing a configuration of a supply passage part for coupling the toner supply assembly mounting mechanism with a developing unit.

To begin with, developing unit 23 will be described.

As shown in FIGS. 2 and 3, in developing unit 23, a toner input port 234*a* for leading the developer is formed as an opening at the top of a casing 234 that forms its exterior. The developing unit incorporates inside casing 234 a developing roller 231, a first toner conveying roller 232 and a second toner conveying roller 233, and is mounted to the image forming apparatus body with the developing roller 231 opposed, in abutment with, or close to, photoreceptor drum 21. This toner input port 234*a* of developing unit 23 is formed at a position further outside of the width W of the transfer belt, on the same side as a toner feed port 611 of a toner supply assembly mounting mechanism 600 is disposed.

First toner conveying roller 232 and second toner conveying roller 233 are disposed in the bottom of casing 234 in parallel with each other along the direction of axis of developing roller 231 so that the toner that is fed into casing 234 is agitated with the developer and conveyed to developing roller 231. Developing roller 231 is arranged over and above first toner conveying roller 232 so as to be exposed from an opening mouth 235.

Casing 234 is a box-shaped configuration elongated in the direction (the width direction of the transfer belt) perpendicular to the direction of transfer (the transfer belt's direction of movement) when mounted in the image forming apparatus body, and is formed with opening mouth 235 so that developing roller 231 therein opposes photoreceptor drum 21 when developing unit 23 is mounted to the image forming apparatus body.

Opening mouth 235 is made open long across the width of casing 234 along the axis direction of developing roller 231 so that at least developing 231 will be able to oppose and abut photoreceptor drum 21. Provided along the bottom edge of opening mount 235 in the drawing is a blade 236 that extends in the axis direction of developing roller 231. Blade 236 is positioned so as to create a predetermined clearance between the blade 236 edge and the developing roller 231 surface, whereby a predetermined amount of toner can be supplied to the developing roller 231 surface through the clearance.

Arranged over the thus constructed developing unit 23 is toner supply device 100.

Referring next to the drawings, the configuration of toner supply device 100 will be described.

In the present embodiment, any of toner supply assemblies 500*a*, 500*b*, 500*c* and 500*d* for respective toner supply devices 100 (100*a*, 100*b*, 100*c* and 100*d*) mounted in image forming apparatus 1 is assumed to have an identical configuration.

As shown in FIGS. 2 and 3, toner supply device 100 is mainly composed of a toner bottle (toner container) 200 that stores toner as a developer, atoner supply assembly 500 having a bottle holder 300 that rotatably holds the toner bottle 200 at its one end, and a toner supply assembly mounting mechanism (toner feed device) 600 (600*a* to 600*d* in FIG. 6) to which the toner supply assembly 500 is mounted so as to feed the toner to developing unit 23.

As shown in FIG. 5, toner bottle 200 is comprised of a main part 201 having an approximately cylindrical shape with its front end part supported by bottle holder 300.

Bottle holder 300 is configured in an approximately cylindrical form that covers the front end part of main part 201.

Next, toner supply assembly mounting mechanism 600 will be described with reference to the drawings.

As shown in FIG. 1, toner supply assembly mounting mechanism 600 is constructed such that toner supply assembly 500 is disposed essentially parallel to, and opposing, developing unit 23 with transfer belt unit 30 interposed there between. Toner supply assembly mounting mechanism 600*a* for black toner is constructed so that two toner supply assemblies 500*a* for storing black toner can be mounted together.

In toner supply assembly mounting mechanism 600, as shown in FIGS. 3, 5 and 6, mount bases 602 onto which toner supply assemblies 500 are mounted are formed lengthwise in the direction (the transfer belt width direction) approximately perpendicular to the transfer belt's direction of conveyance.

As shown in FIG. 5, toner supply assemblies 500 are fixed to corresponding drive mechanisms 701, respectively, on the bottle holder 300 side while toner bottles 200 are fixed by holding belts 702 on the opposite side.

Provided for each drive mechanism 701 is an actuator (not shown) which, when toner supply assembly 500 is mounted to mount base 602, transfers driving force (rotational force) to the bottle by coupling itself with ribs (not shown) of toner bottle 200, which are projected from an opening (not shown) of the aforementioned bottle holder 300. Usually, the actuator is composed of a motor, and is controlled to drive in accordance with the toner supply condition.

On the other hand, holding belt 702 is adapted to hold toner bottle 200 of the toner supply assembly 500 when toner supply assembly 500 is mounted to mount base 602, and is removably attached to mount base 602. Holding belt 702 is attached to mount base 602 to hold toner bottle 200, leaving a clearance so that the toner bottle 200 is rotatable or touching the toner bottle 200 with such friction as to allow the bottle to rotate.

In toner supply assembly mounting mechanism 600, each mount base 602 on which toner supply assembly 500 is to be mounted, has a toner feed port 611 (611*a*, 611*b*, 611*c* or 611*d*) on the upper surface thereof, as shown in FIG. 6. This toner feed port is disposed at one end side on the upper surface where bottle holder 300 of toner supply assembly 500 is mounted. On the underside of the mount base, supply passage part 612 (612*a*, 612*b*, 612*c* or 612*d*) for toner conveyance is provided to establish communication between the toner feed port 611 and developing unit 23 that is arranged under toner supply assembly mounting mechanism 600.

Here in FIG. 6, for description convenience, mount base 602*a* corresponding to toner supply assembly 500*a* of black toner is partially omitted.

As shown in FIGS. 3 and 6, toner supply assembly mounting mechanisms 600 are constructed such that toner fed from toner supply assembly 500 is delivered from toner feed port 611 that is disposed outside the area of the transfer belt with respect to the direction perpendicular to the transfer belt's direction of conveyance, or in short, outside the width W of the transfer belt.

As shown in FIG. 7 each of mount bases 602*b* to 602*d* is formed with a box-shaped casing 610*a* that is elongated in the width direction of the transfer belt. The casing 610*a* incorporates a first toner agitator shaft (toner conveyor means) 610*b* and a second toner agitator shaft (toner conveyor means) 610*c*, arranged parallel to each other along the axis direction of developing roller 231.

The interior of casing 610*a* is divided into a first toner chamber (toner reservoir) 610*e* with first toner agitator shaft 610*b* disposed therein and a second toner chamber (toner reservoir) 610*f* with second toner agitator shaft 610*c* disposed therein, by a partitioning element 610*d*.

First and second toner agitator shafts 610*b* and 610*c* have screws 610*b*1 and 610*c*1 for agitating and conveying toner, respectively, and are driven by an unillustrated drive motor by way of drive gears 610*b*2 and 610*c*2 arranged on the other side 610*a*2 of casing 610*a*.

Toner support plates 610*b*3 and 610*c*3 are provided for first and second toner agitator shafts 610*b* and 610*c*, respectively, at their downstream side ends with respect to the toner conveying direction so as to receive the toner being conveyed.

Here, the toner agitating means should not be limited to screws 610*b*1 and 610*c*1, but it may be a structure in which a multiple number of agitating vanes tilted with the toner conveying direction are formed on the first and second toner agitator shafts 610*b* and 610*c*, for example. Also any other configuration can be used as long as it can achieve the same effect.

Partitioning element 610*d* is formed in casing 610*a* across the casing width along the first and second agitator shafts 610*b* and 610*c*, having toner chamber communication ports 610*d*1 and 610*d*2 formed near both side walls of casing 610*a* to allow for toner passage between first and second toner chambers 610*e* and 610*f*. These toner chamber communication ports 610*d*1 and 610*d*2 permit toner to circulate from first toner chamber 610*e* to second toner chamber 610*f* and from second toner chamber 610*f* to first toner chamber 610*e*.

On the first end side, designated at 610*a*1, of casing 610*a*, a toner feed port (toner input portion) 611 for receiving toner supply from toner bottle 200 arranged on the top thereof is formed while a toner feed port (toner feed portion) 610*a*4 for delivering the toner from casing 610*a* to supply passage part 612 that feeds toner to developing unit 23 arranged below is formed.

The opening of toner feed port 611 is formed at a position opposing part of first toner agitator shaft 610*b* for agitating and conveying toner from first end side 610*a*1 to second end side 610*a*2 of casing 610*a*.

On the other hand, the opening of toner feed port 610*a*4 is formed at a position opposing part of second toner agitator shaft 610*c* for agitating, conveying and circulating toner from second end side 610*a*2 to first end side 610*a*1 of casing 610*a*.

Each of supply passage parts 612*a* to 612*d* which are provided on respective mount bases 602*b*, 602*c* and 602*d* for toner supply assemblies 500 for cyan, magenta and yellow toners is formed so that its top is integrated with toner supply assembly mounting mechanism 600, and a developing unit attachment portion 612*a*1 which is detachably configured attachment to developing unit 23 is provided at the bottom thereof, as shown in FIG. 8.

An opening of a toner input port 612*b* (toner input portion) for toner input is formed at the top of supply passage part 612, and a toner passage 612*c* for toner to pass from this toner input port 612*b* to developing unit attachment portion 612*a*1 is provided approximately linearly from top to bottom.

Figure 9:
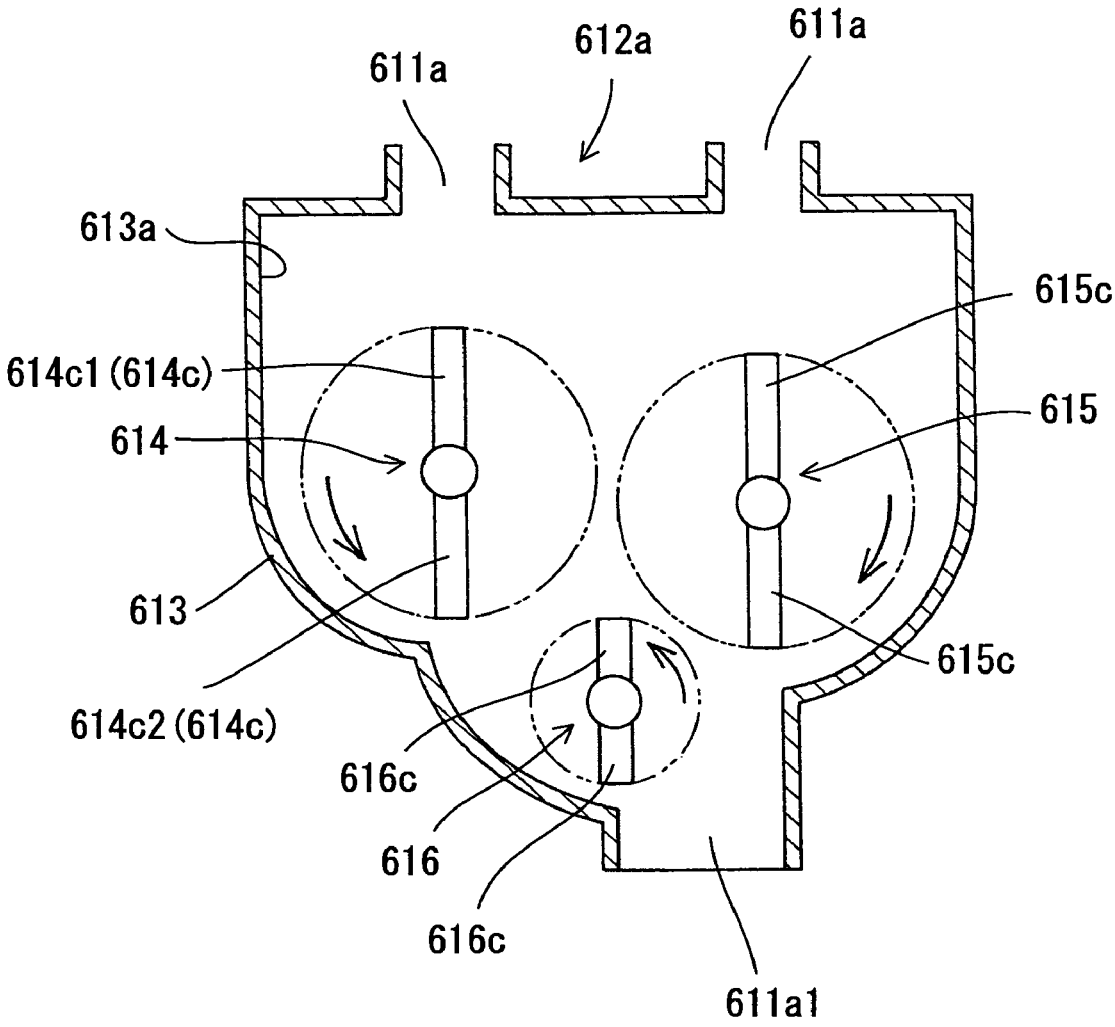
FIG. 9 is an illustrative view showing a configuration of a supply passage part for black toner as a part of the toner supply device.

On the other hand, supply passage part 612*a* provided in mount base 602*a* for toner supply assembly 500*a* for black toner has two toner feed ports 611*a*, 611*a* corresponding to two toner supply assemblies 500*a*, as shown in FIGS. 6 and 9. That is, this supply passage part is constructed so as to receive toner fed from the two ports and temporarily store together and agitate the toner to thereby feed the toner to single developing unit 23*a* for black toner through toner input port 234*a* (FIGS. 2 to 4) formed in developing unit 23*a*. That is, this supply passage part 612*a* has the function of agitating and conveying toner.

Now, the black toner's supply passage part 612*a* (FIG. 6), the characteristic part in accordance with the present invention, will be described with reference to the drawings.

Figure 10:
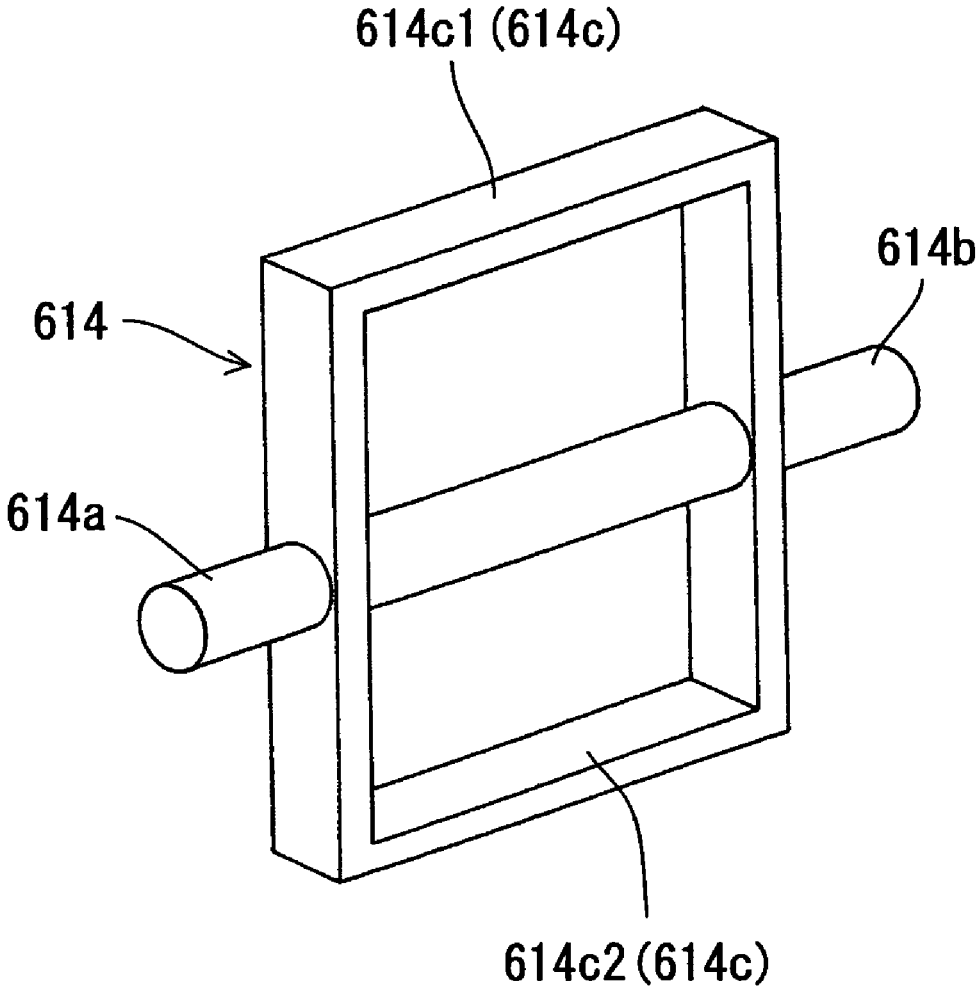
FIG. 10 is an illustrative view showing a configuration of a toner agitation rotor as a part of the supply passage part.
Figure 11:
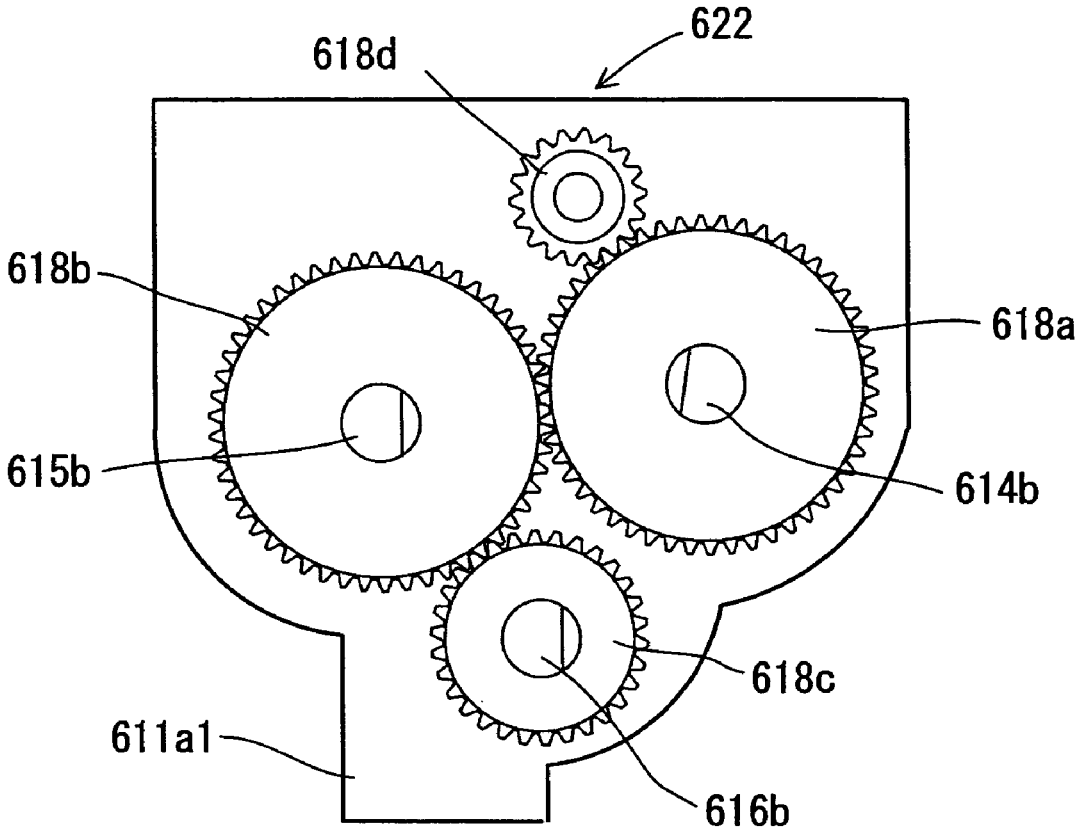
FIG. 11 is an illustrative view on the drive side showing a gear layout for transmitting drive force to the toner agitation rotor.

FIG. 9 is an illustrative view showing the structure of a supply passage part for black toner as a part of a toner supply device according to the present embodiment, FIG. 10 is an illustrative view showing the structure of a toner agitation rotor as a part of the supply passage part, and FIG. 11 is an illustrative view on the drive side showing a layout of gears for transmitting drive force to the toner agitation rotor.

The exterior of black toner's supply passage part 612*a* is formed as a box-like housing 613 having an approximately heart-shaped section viewed from the side, as shown in FIG. 9.

This housing 613 is formed with two toner feed ports 611*a*, 611*a* corresponding to two toner bottles 200, and the interior of housing 613 serves as a temporal reservoir for the toner supplied from the toner feed ports 611*a* and 611*a*.

Inside housing 613, rotary parts 614, 615 and 616 for agitating toner stored therein are rotatably and axially supported. Also, a toner discharge port 611al for supplying toner to developing unit 23 is formed at the bottom of housing 613.

Rotary parts 614 and 615 are disposed under toner feed ports 611*a*, 611*a* for receiving toner supply from respective toner bottles 200, 200 while rotary part 616 is disposed between, and below, rotary parts 614 and 615.

In housing 613, its inner wall 613*a* is formed in a circular arc close to rotary parts 614, 615 and 616 so as not to interfere with the rotational ranges of rotary parts 614, 615 and 616.

Since rotary parts 614, 615 and 616 have similar shapes and configurations, description will be made taking an example of rotary part 614.

As shown in FIG. 10, rotary part 614 is essentially comprised of support shafts 614*a* and 614*b* formed on the same axis and a toner agitation rotor 614*c* formed as a rectangular frame. This toner agitation rotor 614*c* has two linear agitation blades (614*c*1 and 614*c*2), viewed from side, which will axially rotate on support shafts 614*a* and 614*b*. That is, the toner agitation rotor is rotatably and axially supported inside housing 613 by the support shafts 614*a* and 614*b*.

Support shaft 614*a* is rotationally supported as a free shaft by a side wall portion of housing 613 while support shaft 614*b* is disposed projectively outwards from the side wall of housing 613 and has a drive transmission gear 618*a* fitted on its shaft end, as shown in FIG. 11.

Similarly, rotary parts 615 and 616 have drive shafts, namely support shafts 615*b* and 616*b*, on which gears 618*b* and 618*c* are provided at their ends, respectively.

Gears 618*a*, 618*b* and 618*c* for driving rotary parts 614, 615 and 616 are arranged in a manner as shown in FIG. 11, for example so that gears 618*a* and 618*b* are in mesh with each other, gears 618*b* and 618*c* are in mesh, and a gear 618*d* as the drive source for all the gears is in mesh with gear 618*a*. Drive gear 618*d* receives drive force transmitted from an unillustrated drive motor.

In the present embodiment, as shown in FIG. 9, rotary parts 614 and 615 are constructed so that their toner agitation rotors 614*c* and 615*c* will not interfere with each other in their rotating ranges and will rotate in opposite directions by the function of gears 618*a* and 618*b* in mesh.

Specifically, toner agitation rotors 614*c* and 615*c* rotate counterclockwise and clockwise, respectively, so that each move downwards along corresponding inner wall 613*a* of housing 613.

Next, the operation of black toner's supply passage part 612*a* will be described.

Toner to be supplied to supply passage part 612*a* from two toner bottles 200 enters housing 613 through two toner feed ports 611*a* and 611*a*.

Toner fed through toner feed ports 611*a*, 611*a* falls around rotary parts 614 and 615 and is agitated and conveyed by rotary parts 614 and 615. The toner is further agitated whilst being temporarily accommodated inside housing 613. Then, the toner, as it is further agitated by rotary part 616, is conveyed toward toner discharge port 611*a*1.

Specifically, the toner inside housing 613, whilst it being agitated by rotating toner agitation rotors 614*c* and 615*c*, is conveyed from the center of housing 613 to both sides (left and right in the drawing) or toward inner wall 613*a*. Accordingly, the toner can be agitated almost uniformly and distributed to both left and right inside housing 613.

In the present embodiment, since inner wall 613*a* of housing 613 is formed in circular arcs that are close to and along the rotational ranges of toner agitation rotors 614*c* and 615*c*, the toner stored inside housing 613 can be agitated and conveyed without stagnation at and around the inner wall.

Further, since toner agitation rotor 616*c* is arranged between, and below, toner agitation rotors 614*c* and 615*c*, the toner which has been agitated and conveyed by toner agitation rotors 614*c* and 615*c*, from the left and right areas near inner wall 613*a* in housing 613 to the center, can be further agitated and conveyed by toner agitation rotor 616*c* toward toner discharge port 611*a*1.

Moreover, since the inner wall 613*a* of housing 613 near toner agitation rotor 616*c* is also formed in a circular arc close to and along the rotational range of toner agitation rotor 616*c*, the stored toner in housing 613 can be agitated and conveyed without stagnation at around the inner wall.

Thus, the toner supplied to supply passage part 612*a* from two toner bottles 200 can be agitated uniformly inside housing 613 by rotary parts 614, 615 and 616. That is, even if the toner from one toner bottle 200 is different in agitated condition from that from the other, use of supply passage part 612*a* enables constant delivery of uniformly agitated toner to developing unit 23.

According to the present embodiment thus constructed, since toners supplied from two black toner bottles 200 are put together inside housing 613 of supply passage part 612*a*, where the toners are agitated and mixed by rotary parts 614, 615 and 616 to be delivered to developing unit 23, it is possible to simplify the toner conveyance path to developing unit 23. In addition, since the toner is conveyed as being agitated, it is possible to realize stable toner supply by preventing occurrence of toner clogging.

Further, since gears 618*a*, 618*b* and 618*c* as the drive portions of rotary parts 614, 615 and 616 are arranged integrally outside housing 613 of supply passage part 612*a*, this configuration simplifies the drive portions and makes it possible to realize a space-saving toner supply device.

Here, though in the present embodiment rotary parts 614, 615 and 616 for agitating toner are provided with rectangular frame-shaped toner agitation rotors 614*c*, 615*c* and 616*c*, the rotary parts should not be limited to the above rectangular frame-shaped configurations. For example, a slit-formed plate-like agitator, grating-formed agitator, or a rotary part with multiple bars may be turned for toner agitation.

In addition, though in the present embodiment, toner agitation rotors 614*c* and 615*c* of rotary parts 614 and 615 are disposed so that their rotational ranges do not interfere with each other, the present invention should not be limited to this rotary parts arrangement. For example, an embodiment as follows may also be possible.

Figure 12:
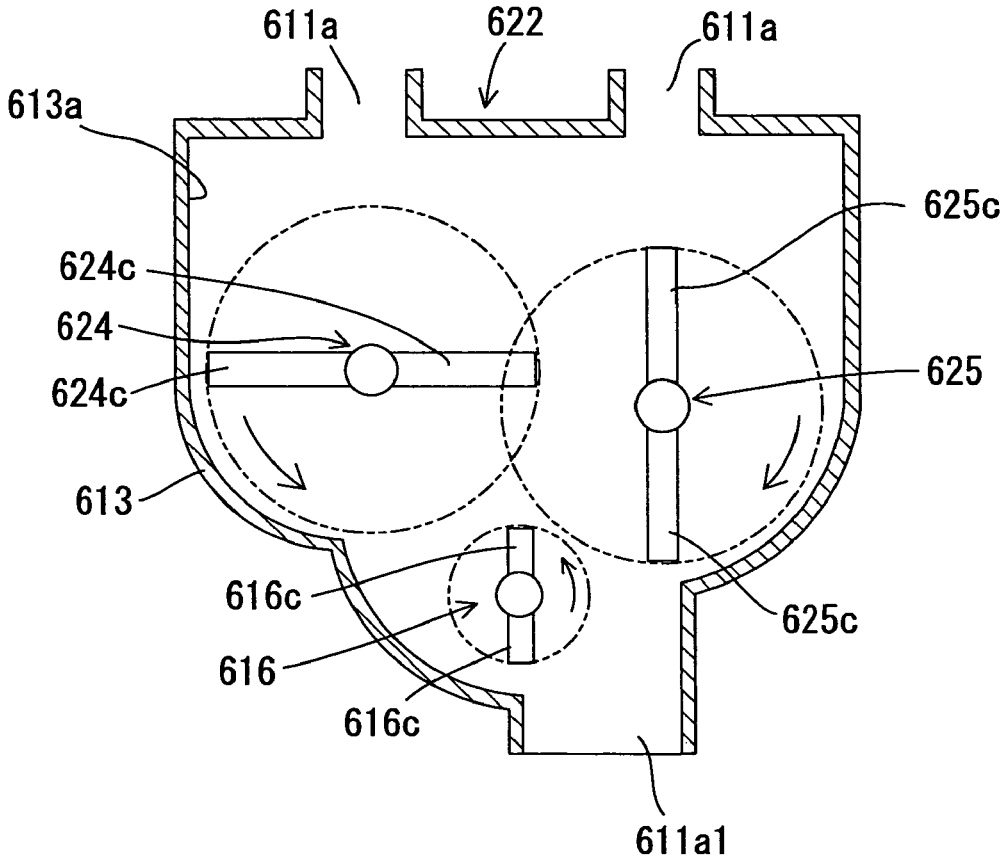
FIG. 12 an illustrative view showing a variational example of a supply passage part according to the present embodiment.

As a variational example of supply passage part 612*a* having a toner feed function for the toner supply device of the above embodiment, a supply passage part 622 may be configuration as shown in FIG. 12. That is, rotary parts 624 and 625 laid out inside housing 613 may be disposed so that the rotational range of toner agitation rotor 624*c* of rotary part 624 and the rotational range of toner agitation rotor 625*c* of rotary part 625 overlap each other while gears 618*a* and 618*b* for driving rotary parts 624 and 625 are arranged in mesh with each other so that they will rotate in opposite directions and toner agitation rotors 624*c* and 625*c* may be rotated 90-degrees out of phase with each other.

Here, since the configuration of supply passage part 622 in this embodiment has essentially the same configuration as supply passage part 612 of the former embodiment, so that description is omitted by allotting the same reference numerals to the corresponding components.

This configuration enables toner agitation rotors 624*c* and 625*c* to agitate the toner supplied in housing 613, by turns in the overlapping range, so that it is possible to achieve high efficient toner agitation. In addition, since it is possible to narrow the spacing between rotary parts 624 and 625, hence a further space-saving toner supply device can be realized.

Though the present embodiment has been described taking an example in which toner supply device 100 is applied to the image forming apparatus shown in FIG. 1, the present invention should not be limited to this. For example, the toner supply device may be applied to a copier 101 as shown in FIG. 13.

Figure 13:
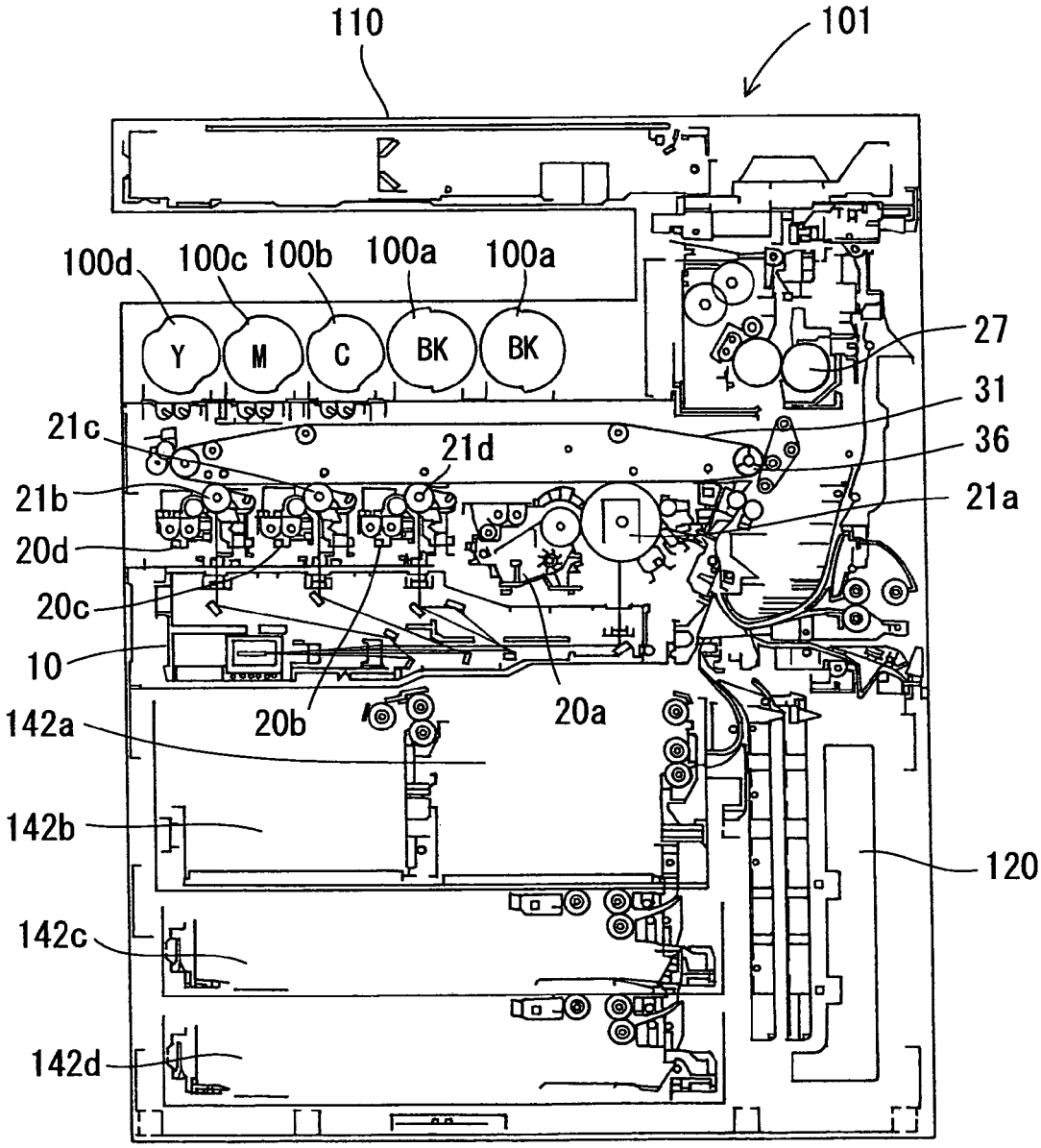
FIG. 13 is an illustrative view showing an overall configuration of a copier according to another embodiment of the present invention.

As shown in FIG. 13, copier 101 includes an image reader (scanner) 110 disposed above an image forming portion 108 having almost the same configuration as that of image forming apparatus 1 according to the present embodiment, and first, second, third and fourth paper feed cassettes 142*a*, 142*b*, 142*c* and 142*d* disposed under image forming portion 108 for supporting multiple kinds of paper, to thereby facilitate a variety of and a large amount of automatic printing.

In the drawing, a reference numeral 120 designates a waste toner box for collecting waste toner.

Here, in copier 101, the same components as those in image forming apparatus 1 of the aforementioned embodiment will be allotted with the same reference numerals and description is omitted.

According to the thus configured copier 101, use of the aforementioned toner supply device 100 makes it possible to achieve the same effect as obtained in the image forming apparatus 1 of the above embodiment mode and example.

Further, the present invention can be developed into any form of other kinds of image forming apparatuses etc., not limited to the image forming apparatus and copier having the above configurations, as long as it is an image forming apparatus needing a supply of developer (toner).

As has been described above, the present invention should not be limited to the above embodiment, and various changes can be made within the range specified in the scope of claims. That is, any embodied mode obtained by combination of technical means modified as appropriate without departing from the spirit and scope of the present invention should be included in the technical art of the present invention.

What is claimed is:

1. A toner supply device for agitating toner and delivering the agitated toner to a developing unit, comprising:

a plurality of toner containers for storing toners of one color; and a toner feed device having a toner reservoir for reserving toners supplied from said plurality of toner containers and a toner agitator comprising a plurality of rotary parts each having a toner agitation rectangular rotor for agitating toner in the toner reservoir, wherein the toner reservoir reserves the toners supplied from said plurality of toner containers in a substantially undivided single space lacking any partitioning members, and the toner agitator mixes and agitates the toners from said plurality of toner containers, and wherein the toner is agitated in only a single chamber lacking any partitioning members.

2. The toner supply device according to claim 1, wherein rotary parts that are located side by side rotate in opposite directions.

3. The toner supply device according to claim 1, wherein rotary parts that are located side by side are arranged at such positions that their rotational loci overlap each other.

4. The toner supply device according to claim 1, wherein rotary parts that are located side by side are made to rotate out of phase with each other.

5. The toner supply device according to claim 1, wherein gears are used to transmit driving force for rotation to the rotary parts.

6. A developing unit equipped with a toner supply device for agitating toner and delivering the agitated toner to the developing unit, the toner supply device comprising:

a plurality of toner containers for storing toners of one color; and a toner feed device having a toner reservoir for reserving toners supplied from said plurality of toner containers and a toner agitator for agitating toner in the toner reservoir, wherein the toner supply device is defined in claim 1.

7. The toner supply device according to claim 1, wherein the rotary parts are arranged near the areas around which toners from the multiple toner containers are loaded.

8. The toner supply device according to claim 7, wherein the toner agitator further includes a rotary part having a toner agitation rotor disposed under the rotary parts that are arranged near the areas around which toners from the multiple toner containers are loaded.

9. The toner supply device according to claim 7, wherein rotary parts that are located side by side rotate in opposite directions.

10. The toner supply device according to claim 7, wherein rotary parts that are located side by side are arranged at such positions that their rotational loci overlap each other.

11. The toner supply device according to claim 7, wherein rotary parts that are located side by side are made to rotate out of phase with each other.

* * * * *